US005253375A

United States Patent [19]

Prosper

[11] Patent Number: 5,253,375

[45] Date of Patent: Oct. 19, 1993

[54] COMMODE COVER

[76] Inventor: Ricardo Prosper, R.F.D. Buzon 266, Anasco, P.R. 00610

[21] Appl. No.: 905,667

[22] Filed: Jun. 29, 1992

[51] Int. Cl.[5] ..... E03D 1/00

[52] U.S. Cl. ..... 4/661; 4/353; 4/901

[58] Field of Search ..... 4/353, 661, 901, 254

[56] References Cited

U.S. PATENT DOCUMENTS

| | | | |
|---|---|---|---|
| Re. 12,321 | 2/1905 | Crosby | 4/353 |
| D. 243,088 | 1/1977 | Halvorsen | 4/661 X |
| 2,749,968 | 6/1956 | Suser | 4/661 |
| 3,716,872 | 2/1973 | Zieman | 4/661 X |
| 3,905,051 | 9/1975 | Gozdziewski | 4/661 |
| 4,368,551 | 1/1983 | Cummings | 4/661 |

*Primary Examiner*—Henry J. Recla
*Assistant Examiner*—Robert M. Fetsuga
*Attorney, Agent, or Firm*—Leon Gilden

[57] ABSTRACT

A commode cover includes a seat plate having an opening having an annular channel member arranged peripherally about the opening for mounting upon an upper end of the commode bowl. The structure is formed with spaced rear walls positioned between side walls to receive the toilet tank. The cover is arranged to further accommodate a radio and speaker arrangement for entertainment of individuals.

2 Claims, 4 Drawing Sheets

COMMODE COVER

BACKGROUND OF THE INVENTION

1. Field of the Invention

The field of invention relates to commode apparatus, and more particularly pertains to a new and improved commode cover wherein the same is arranged to afford covering and camouflage of a commode.

2. Description of the Prior Art

Commodes, and particularly commodes of older construction, are accommodated by the instant invention to provide for an attractive cover structure having a removal cushion for access to the commode and camouflage of the commode during periods of non-use. Commode covers of the prior art have heretofore not addressed the camouflaging of the entire commode structure, such as exemplified in the U.S. Pat. No. 4,649,575 to Blair providing for a covering of the commode seat alone as is further the case of the Tissot, et al. U.S. Pat. No. 4,965,889.

Accordingly, it may be appreciated there continues to be a need for a new and improved commode cover as set forth by the instant invention which addresses the problems of ease of use as well as effectiveness in construction in providing for the camouflage of existing commode structure and in this respect, the present invention substantially fulfills this need.

SUMMARY OF THE INVENTION

In view of the foregoing disadvantages inherent in the known types of commode cover arrangements now present in the prior art, the present invention provides a commode cover wherein the same provides for the receiving of a commode therewithin having a removable cushion for access to the commode. As such, the general purpose of the present invention, which will be described subsequently in greater detail, is to provide a new and improved commode cover which has all the advantages of the prior art commode cover and none of the disadvantages.

To attain this, the present invention provides a commode cover including a seat plate having an opening having an annular channel member arranged peripherally about the opening for mounting upon an upper end of the commode bowl. The structure is formed with spaced rear walls positioned between side walls to receive the toilet tank therewithin. The invention is arranged to further accommodate a radio and speaker arrangement for entertainment of individuals.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode cover which has all the advantages of the prior art commode covers and none of the disadvantages.

It is another object of the present invention to provide a new and improved commode cover which may be easily and efficiently manufactured and marketed.

It is a further object of the present invention to provide a new and improved commode cover which is of a durable and reliable construction.

An even further object of the present invention is to provide a new and improved commode cover which is susceptible of a low cost of manufacture with regard to both materials and labor, and which accordingly is then susceptible of low prices of sale to the consuming public, thereby making such commode covers economically available to the buying public.

Still yet another object of the present invention is to provide a new and improved commode cover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
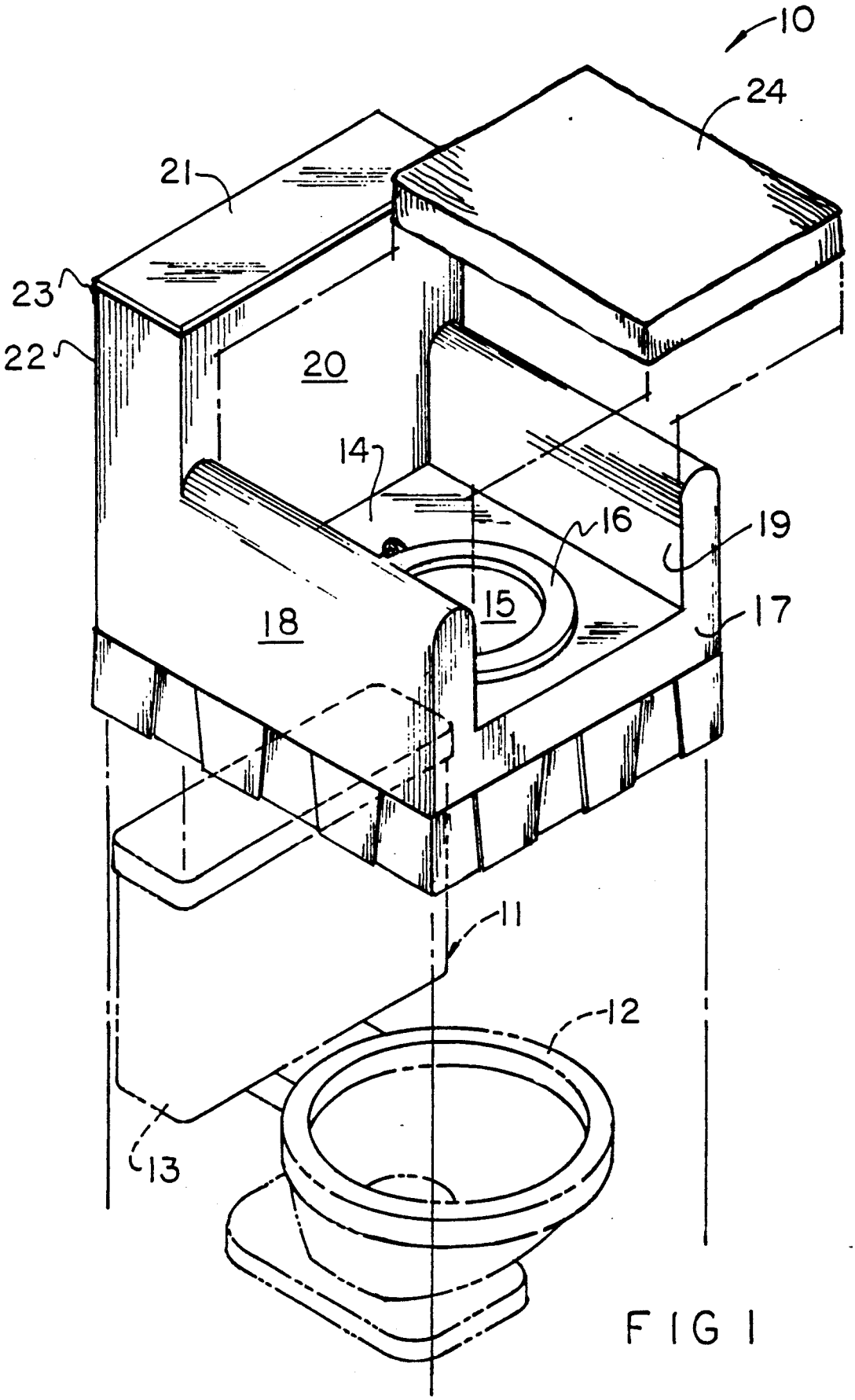
FIG. 1 is an isometric illustration of the instant invention.

With reference now to the drawings, and in particular to FIGS. 1 to 6 thereof, a new and improved commode cover embodying the principles and concepts of the present invention and generally designated by the reference numerals 10, 10*a*, and 10*b* will be described.

Figure 3:
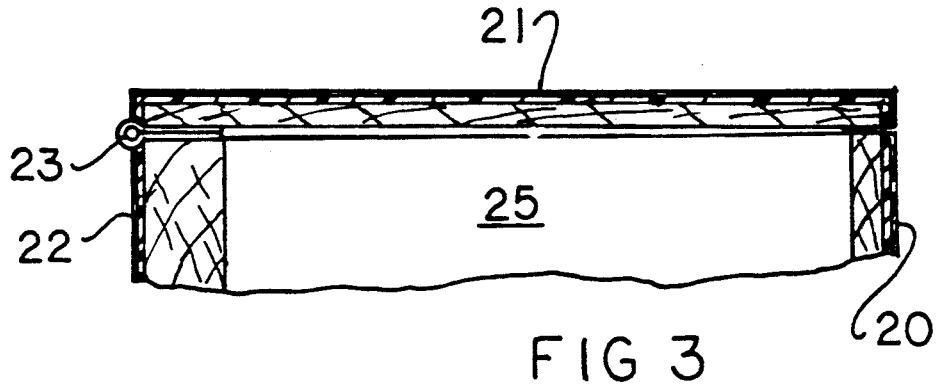
FIG. 3 is an orthographic view, taken along the lines 3—3 of FIG. 2 in the direction indicated by the arrows.

More specifically, the commode cover 10 of the instant invention essentially comprises mounting over a commode 11 having a commode bowl 12 and a tank 13 projecting upwardly and rearwardly of the bowl 12. The cover 10 includes a seat plate 14 having a seat plate opening 15 medially of the seat plate, with an annular channel 16 mounted in a perimeter continuous relationship about the opening 15 to receive the upper end of the commode bowl 12. The cover structure includes a front wall 17 orthogonally mounted and extending downwardly relative to the seat plate 14, with respective first and second L-shaped side walls 18 and 19 arranged in a parallel coextensive relationship on opposed sides of the seat plate orthogonally mounted to the front wall. A first rear wall 20 mounted to the lowermost portion of each of the rear walls in a parallel relationship relative to the front wall is spaced from and parallel a second rear wall 22. Rear wall top plate 21 hingedly mounted about a hinge 23 to the second rear wall and to an upper edge of the second rear wall permits access to the commode tank 13, in a manner as illustrated in FIG. 3, wherein the spacing of the first and second rear walls 20 and 22 defines a tank receiving cavity 25 directed between the rear walls and the side walls of the cover structure. The cushion member 24 is provided positioned between the side walls and extending from the first rear wall 20 to the front wall 17. Removal of the cushion member 24 permits access to the commode howl 12, in a manner as indicated in FIG. 1 for example.

Figure 2:
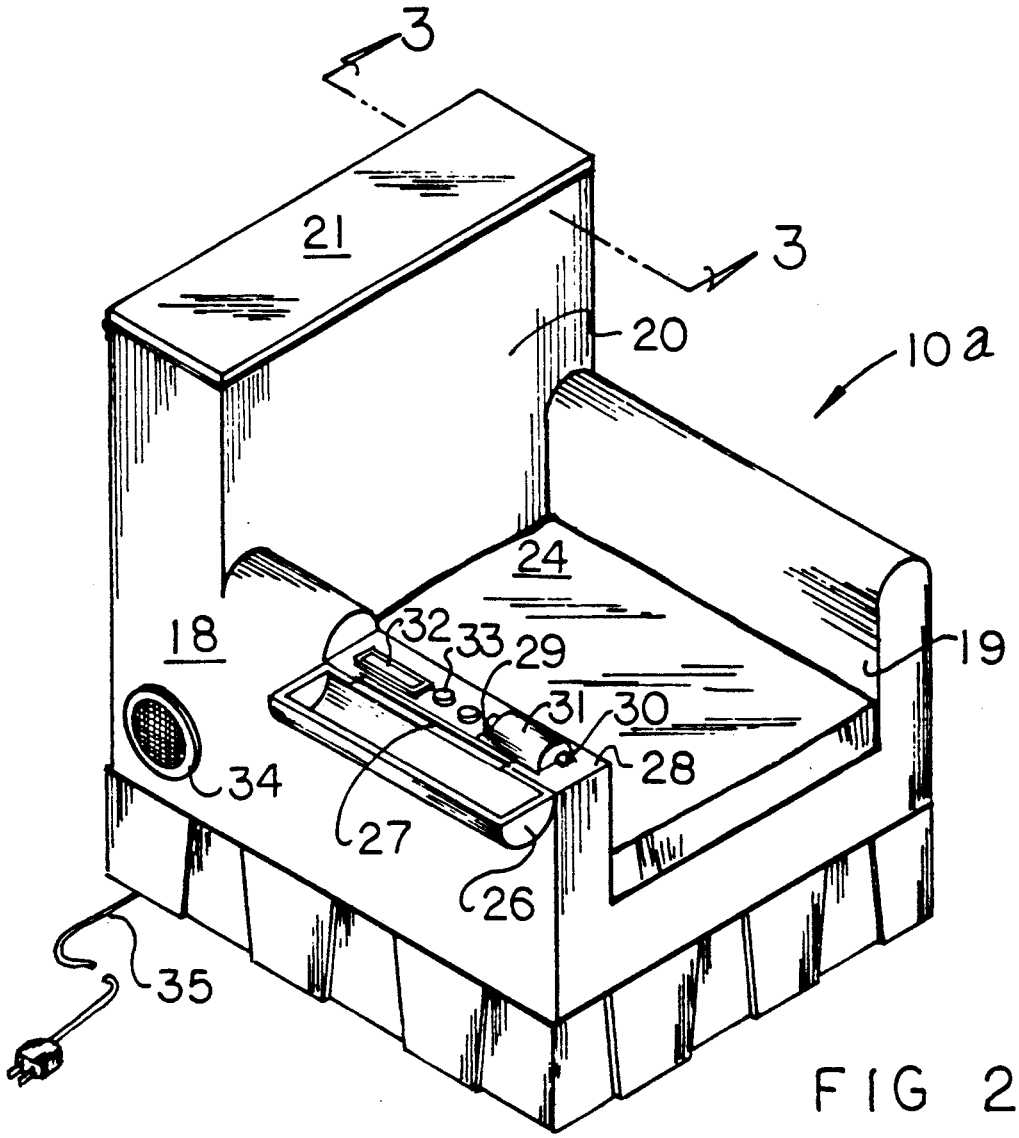
FIG. 2 is an isometric illustration of a modified aspect of the invention.
Figure 4:
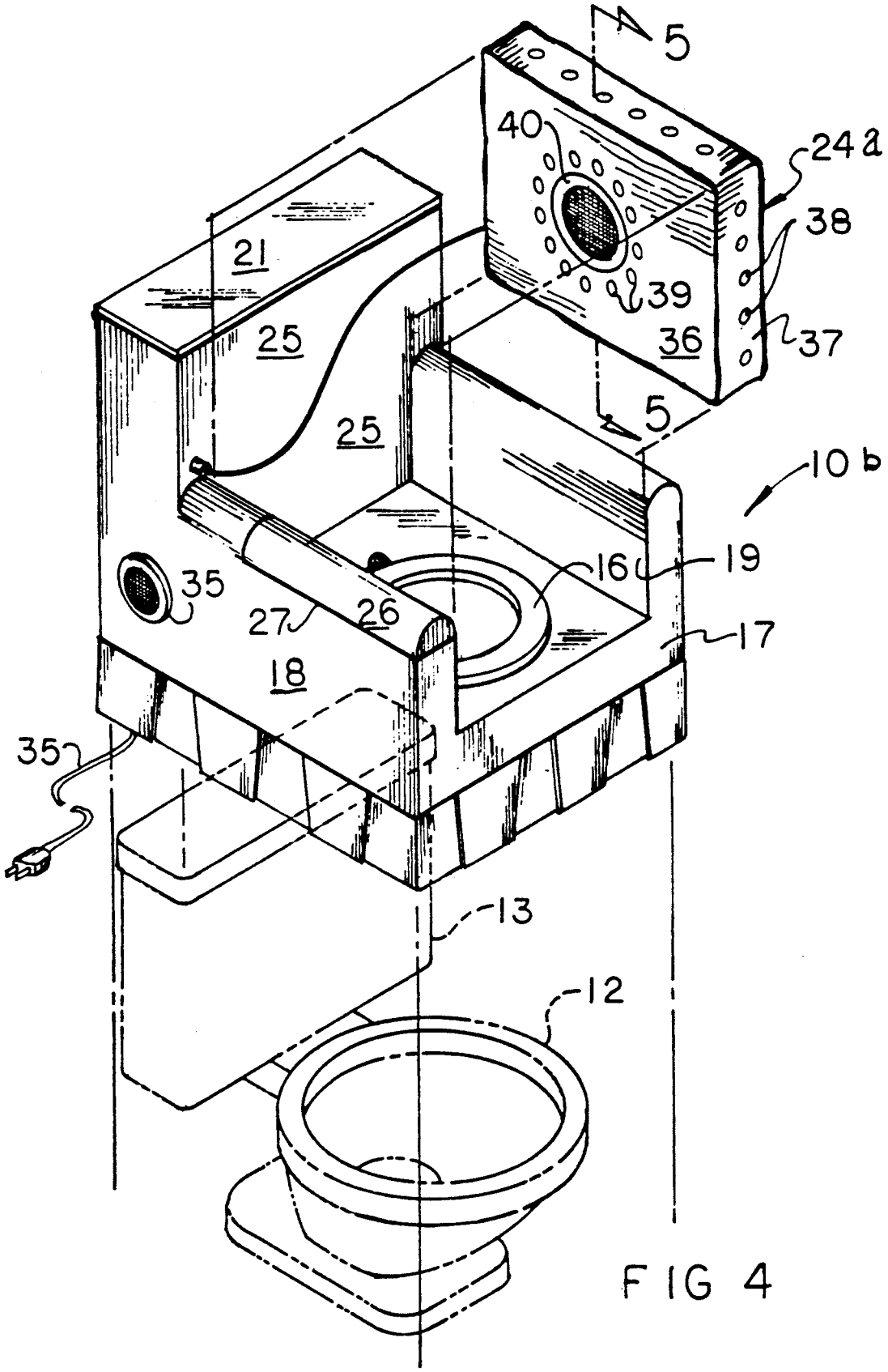
FIG. 4 is an isometric illustration of further modified aspect of the invention.
Figure 5:
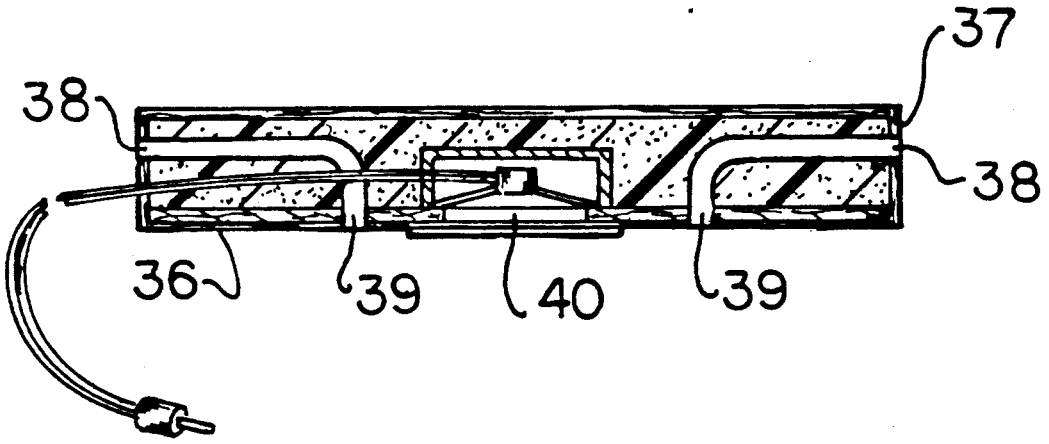
FIG. 5 is an orthographic view, taken along the lines 5—5 of FIG. 4 in the direction indicated by the arrows.
Figure 6:
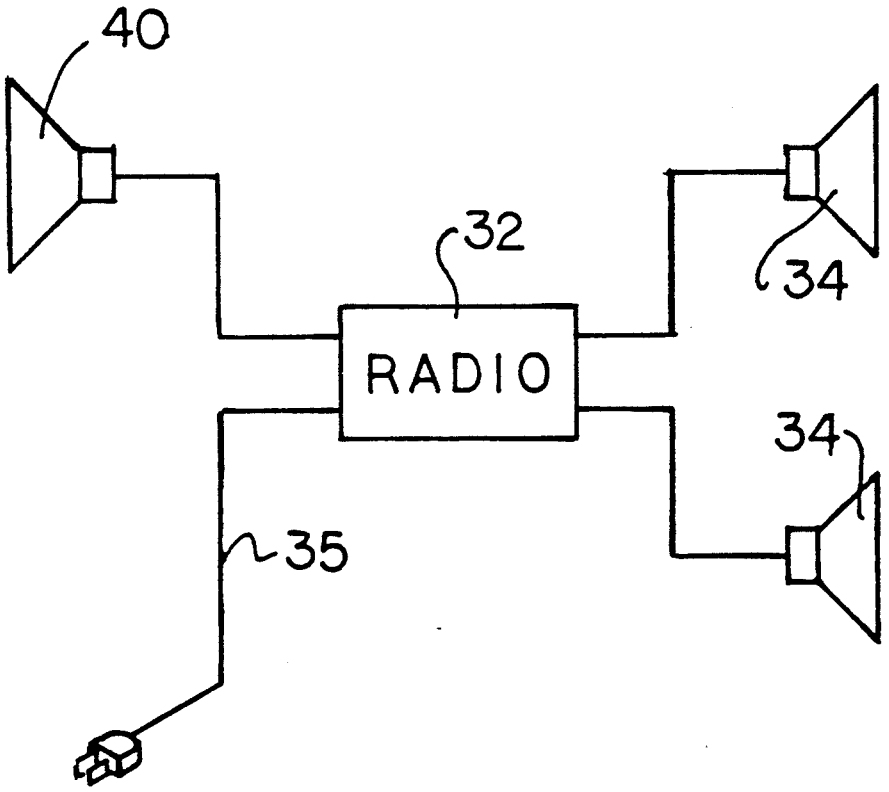
FIG. 6 is a diagrammatic illustration of the radio and the associated speakers utilized by the instant invention.

The FIG. 2 illustrates a commode cover structure 10*a* having a first side wall cap 26 hingedly mounted to the first side wall about a wall cap hinge 27 for access to an underlying cap plate 28 that is oriented substantially orthogonally relative to the first side wall 18 in adjacency to the cushion member 24. The cap plate 28 includes a first cavity 29 having a mandrel 30 rotatably mounted relative to the first cavity for rotatably mounting a tissue roll 31 thereabout. A radio 32 is directed into the cap plate 28 operative through control knobs 33 to effect directing of audible projection to the speakers 34 exemplified in FIG. 2 directed through the side walls 18 and 19.

An electrical power supply line 35 is in operative communication between the radio 32 and the speakers 34 in a conventional manner. Further, the commode cover 10*b*, as indicated in the FIG. 4, further utilizes a further speaker member 40 through a cushion bottom wall 36. The further speaker member 40 positioned medially of the cushion bottom wall 36 positioned over the commode bowl 12 effecting its use as a sound chamber. Audible vibrations directed from the sound chamber are projected through bottom wall openings 39 arranged in an annular array about the further speaker member 40 to emanate and project from the cushion member 24*a* through side wall openings 38, through the cushion member's continuous side wall 37.

As to the manner of usage and operation of the instant invention, the same should be apparent from the above disclosure, and accordingly no further discussion relative to the manner of usage and operation of the instant invention shall be provider.

With respect to the above description then, it is to be realized that the optimum dimensional relationships for the parts of the invention, to include variations in size, materials; shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode cover arranged for receiving a commode therewith, wherein the commode includes a commode bowl, the commode bowl including a bowl upper end, and a commode tank projecting upwardly of the commode bowl, wherein the commode cover comprises, a seat plate, the seat plate having a seat plate opening medially of the seat plate, with the seat plate opening including an annular channel arranged for receiving the bowl upper end therewithin, the annular channel arranged in a peripheral continuous relationship about the seat plate opening, and the seat plate including a front wall orthogonally mounted to a forward end of the seat plate extending downwardly therefrom, and a first rear wall orthogonally mounted to a second end of the seat plate extending upwardly thereof and oriented parallel relative to the front wall, and the seat plate further including a first side wall spaced from and parallel to a second side wall;

and a second rear wall spaced from and parallel rearwardly of the first rear wall, and a rear wall top plate, and a hinge, with the hinge mounted to the rear wall top plate and to the second rear wall for hingedly mounting the rear wall top plate over the second rear wall and the first rear wall, and a cushion member, the cushion member removably mounted between the first side wall and the second side wall, the first rear wall and the front wall, and the first side wall includes a cap plate at an upper end of the first side wall, and a first side wall cap, and a first side wall cap hinge, with the first side wall cap hinge secured to the first side wall and to the first side wall, with the first side wall cap arranged in a coextensive relationship over the cap plate, with the cap plate including a first cavity having a mandrel, with the mandrel arranged for rotatably mounting a tissue roll within the first cavity, and a radio directed through the cap plate, with the radio having control knobs mounted onto the cap plate for effecting operation of the radio, and each side wall including a speaker in operative communication with the radio.

2. A commode cover as set forth in claim 1 where in the cushion member includes a cushion member bottom wall and a cushion member continuous side wall, and a further speaker member mounted through the cushion member bottom wall medially of the cushion member bottom wall arranged for projection medially through the seat plate opening, with the cushion member bottom wall including an annular array of bottom wall openings and an annular array of side wall openings, wherein each of said bottom wall openings is in operative communication with one of said side wall openings to direct audible vibrations from the further speaker member through the side wall openings from the bottom wall openings.

* * * * *